US008365313B2

(12) United States Patent
Greenblat

(10) Patent No.: US 8,365,313 B2
(45) Date of Patent: Feb. 5, 2013

(54) REVERSIBLE SLEEVED GARMENT ACCESSORY

(75) Inventor: Ruth Ann Greenblat, Diamond Bar, CA (US)

(73) Assignee: R and A Synergy, Diamond Bar, CA (US)

( * ) Notice: Subject to any disclaimer, the term of this patent is extended or adjusted under 35 U.S.C. 154(b) by 177 days.

(21) Appl. No.: 12/699,751

(22) Filed: Feb. 3, 2010

(65) Prior Publication Data

US 2010/0199403 A1 Aug. 12, 2010

Related U.S. Application Data

(60) Provisional application No. 61/281,474, filed on Nov. 17, 2009, provisional application No. 61/278,647, filed on Oct. 9, 2009, provisional application No. 61/206,706, filed on Feb. 3, 2009.

(51) Int. Cl.
*A41D 1/00* (2006.01)

(52) U.S. Cl. ..... 2/69

(58) Field of Classification Search ..... 2/113, 115, 2/106, 269, 118, 119, 125, 126, 55; 450/1, 450/86, 3, 4, 7, 11, 30, 66, 91
See application file for complete search history.

(56) References Cited

U.S. PATENT DOCUMENTS

| | | | | |
|---|---|---|---|---|
| 593,175 | A | 11/1897 | Heyman | |
| 1,155,544 | A | 10/1915 | Bonoff | |
| 1,236,720 | A | 8/1917 | Kotek | |
| 1,269,805 | A | 6/1918 | Felberbaum | |
| 1,637,518 | A | 8/1927 | Brunk et al. | |
| 2,313,519 | A | 3/1943 | Cuttler | |
| 2,334,498 | A | 11/1943 | Merkent | |
| 2,382,396 | A | 8/1945 | Carlu | |
| 2,603,788 | A | 7/1952 | Page | |
| 2,677,131 | A | 5/1954 | Shuster | |
| 2,690,565 | A | 10/1954 | Cornet | |
| 2,774,075 | A | 12/1956 | Saccoccio | |
| 3,378,853 | A | 4/1968 | Fierst | |
| 3,380,075 | A | 4/1968 | Marthinsson | |
| 4,625,338 | A * | 12/1986 | Starling | 2/106 |
| 4,866,791 | A | 9/1989 | Carver | |
| 4,956,878 | A * | 9/1990 | Boynton | 2/67 |
| 5,038,414 | A * | 8/1991 | Freeman | 2/409 |
| D331,138 | S * | 11/1992 | Kopp et al. | D2/703 |
| 5,628,064 | A | 5/1997 | Chung | |
| 5,667,422 | A * | 9/1997 | Erwin | 450/30 |
| 6,012,166 | A * | 1/2000 | Burbidge | 2/83 |
| 6,183,339 | B1 | 2/2001 | Thompson | |
| 6,282,720 | B1 * | 9/2001 | Mayer | 2/113 |
| 6,393,611 | B1 | 5/2002 | Thompson | |
| 6,430,748 | B1 * | 8/2002 | Burkhart | 2/78.1 |
| 7,066,784 | B2 | 6/2006 | Peay | |
| D553,827 | S * | 10/2007 | Mehes | D2/846 |
| 7,395,557 | B1 * | 7/2008 | Ledyard | 2/113 |
| 2007/0163026 | A1 * | 7/2007 | Perry | 2/69 |
| 2009/0098801 | A1 * | 4/2009 | Pedersen et al. | 450/7 |

OTHER PUBLICATIONS

The Snapsource; Intro to Snap Fasteners; www.snapsource.com.
UTSAV; www.utsavsarees.com.
Choli; Fashion Encyclopedia: The Ancient World—India; www.fashionencyclopaedia.com.

* cited by examiner

*Primary Examiner* — Khoa Huynh
*Assistant Examiner* — Anna Kinsaul
(74) *Attorney, Agent, or Firm* — The Eclipse Group LLP

(57) ABSTRACT

A reversible garment accessory of the invention designed to be seamlessly worn with sleeveless or strapless tops, dresses or other garments for the purpose of varying the appearance of the original garment, while at the same time concealing a woman's arms without adding undue bulkiness on the torso of the wearer.

11 Claims, 17 Drawing Sheets

REVERSIBLE SLEEVED GARMENT ACCESSORY

CROSS-REFERENCE TO RELATED APPLICATIONS

This application claims priority of U.S. Provisional Application Ser. No. 61/281,474 filed Nov. 17, 2009 titled REVERSIBLE SLEEVED GARMENT ACCESSORY; U.S. Provisional Application Ser. No. 61/278,647, filed on Oct. 9, 2009, titled REVERSIBLE SLEEVED GARMENT ACCESSORY; and U.S. Provisional Application Ser. No. 61/206,706 filed Feb. 3, 2009 titled ATTACHABLE SLEEVES; which applications are all incorporated by reference in this application in their entirety.

BACKGROUND OF THE INVENTION

1. Field of the Invention

This invention relates to a reversible sleeved garment, and in particular, to a reversible sleeved garment that may be worn to enhance sleeveless or strapless garments.

2. Related Art

Several attempts have been made to create sleeved undergarments for individuals to wear over conventional brassieres (or having integrated brassieres) for the purpose of concealing or covering a wearer's arms. The undergarments currently available are not, however, designed to create the appearance of being part of the garment with which they are worn. The garments currently on the market include unsightly seams that do not match the garment design with which they are worn or do not provide the correct type of coverage over one's chest. As such, the portion of the garment covering one's chest may be visible when worn with sleeveless or strapless garments. Further, no garments on the market currently allow for a wearer to reverse the garment to vary the style of the garment and vary the level of coverage across the chest area for the wearer.

Accordingly, a need exists for a garment accessory that can be worn under any type of sleeveless or strapless garment to create an appearance that the garment accessory is part of the overlying garment. A need further exists for a garment accessory that does not have visible seams and that can be worn with both low cut and high neckline garments without exposing the garment accessory through the front of the overlying garment. A need further exists for a garment accessory that enhances both the original garment, conceals the arms of the wearer, while at the same time expanding a woman's wardrobe. By concealing the arms of the wearer, arm flab, loose skin, tattoos and age spots may also be concealed to make the wearer's arm appear slimmer, firmer, and more youthful. Finally, a need further exists for a sleeved garment accessory that not only can be worn under any type of sleeveless or strapless garment to create the appearance that it is part of the overlying garment and that covers the wearer's arms, but that also provides support to the midriff section of the wearer to create a slimmer fit.

SUMMARY

The invention provides a reversible garment accessory comprised at least partially of an elastic material permitting the garment to stretch. The reversible garment accessory includes a circular torso member having a first face section and a second face section and two opposing sleeve members extending therefrom. The first face section is designed to provide minimal coverage for a wearer and the second face section is designed to provide fuller coverage, such that the garment can be worn with either the first face section or the second face section facing forward over the chest of the wearer to conceal the garment accessory under an overlying garment, as desired, depending upon the neckline and cut of the overlying garment.

In one example of an implementation, the garment accessory further includes an elastic band member that encircles the torso. The elastic band member may be a one piece elastic member that is permanently affixed at opposing ends through stitching to create a unitary elastic band encircling the torso and that requires the garment to be pulled over or stepped into. Alternatively, the elastic band may include a closure device to be secured together by the user, such as a clip, clasp, hooks, or other fastening mechanism.

In another example of an implementation, the garment accessory may further include a midriff or bodice section that may be made of a material to shape the midriff or torso of the wearer.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
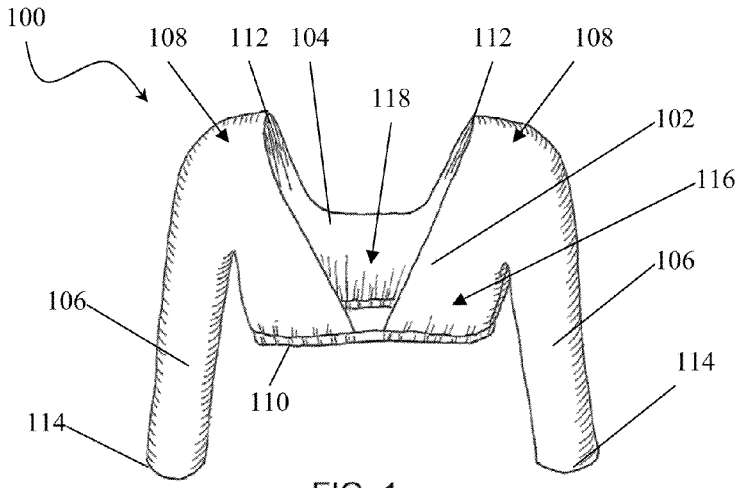
FIG. 1 is a front perspective view of one example of a reversible sleeved garment accessory of the invention illustrating the garment accessory with the low-cut side of the garment accessory in the front and the full coverage side in the back.

As illustrated in the attached FIGS. 1-35, several examples of various implementations of a reversible garment accessory are provided. As illustrated, the reversible garment accessory of the invention is designed to be seamlessly worn with sleeveless or strapless tops, dresses or other garments for the purpose of varying the appearance of the original garment, while at the same time concealing a woman's arms without adding undue bulkiness on the torso of the wearer.

As illustrated in FIGS. 1-35, the garment accessory 100, 200, 300 and 400 of this invention is designed to be reversible and provide versatility to the wearer. Each garment accessory 100, 200, 300 and 400 has (i) a first face (or first side) 102, 202, 302, 402 that is designed to create an open, low-cut neckline (i.e., low-cut side) and (ii) a second face (or second side) 104, 204, 304, 404 that is designed to provide fuller coverage to the wear to conceal or partially conceal overt cleavage (i.e., full coverage side) by providing a higher neckline than the low-cut side. Each garment accessory 100, 200, 300 and 400 also includes sleeves or arms 106, 206, 306, 406 that have shoulder portions 108, 208, 308 and 408 that may be designed to enable the shoulder portions to be rolled down to create an off-the shoulder look when worn by the wearer.

As illustrated in FIGS. 1-35, the garment accessory 100, 200, 300 and 400 and can be worn four different ways: (i) with the first face 102, 202, 302, 402 forward to create an open, low-cut neckline and having the shoulder portions 108, 208, 308 and 408 of the sleeves 106, 206, 306, 406 covering the shoulders; (ii) with the first face 102, 202, 302, 402 forward to create an open, low-cut neckline and having the shoulder portions 108, 208, 308 and 408 of the sleeves 106, 206, 306, 406 rolled down to create an off-the shoulder look; (iii) with the second face 104, 204, 304, 404 forward and having the shoulder portions 108, 208, 308 and 408 of the sleeves 106, 206, 306, 406 covering the shoulders; or (iv) with the second face 104, 204, 304, 404 forward to provide fuller coverage and having the shoulder portions 108, 208, 308 and 408 of the sleeves 106, 206, 306, 406 rolled down to create an off-the shoulder look.

The garment accessory 100, 200, 300 and 400 may be made from a variety of materials and may be designed specifically to match a particular type of garment or garment line. For example, the garment accessory 100, 200, 300 and 400 may be made from a light-weight material, such as a thin, light wear, sheer or semi-sheer stretch material. By way of example, the material may be made at least partially from a spandex blend, which is sold under the trademark Lycra®, owned by DuPont, and may be constructed as either a four-way or two-way stretch material. The garment may further include other materials in addition to spandex, such as cotton, and may even be constructed partially or entirely of a non-stretch material. The expandability of the material of the garment accessory may further vary, and may be designed of stretch such that one garment can be worn by women of varying sizes, such as XS, S, M, L, XL and XXL, or may be designed of more contrasting material to fit the wearer based upon standard children and women's clothing sizes, including plus sizes. The selected material may have the versatile potential to keep the wearer cool when it is made from an open weave or thin sheer fabric, yet have the potential to keep the wearer warm in colder weather, if it is made from a heavier weight fabric. The garment accessory 100, 200, 300 and 400 may further be constructed from fabrics having various designs, thicknesses and colors. For example, the garment accessory 100, 200, 300 and 400 may be constructed from a highly versatile solid or sheer black fabric, which may be capable of being paired with a large number of sleeveless and strapless garments. Further, the garment accessory 100, 200, 300 and 400 may further include various sleeve and cuff designs, may be made from a mesh or net material and may have plain elastic bands at the end of the sleeves, as well as other alternative design or aesthetic variations, to create an alternative looks.

The garment accessory 100, 200, 300 and 400 may be made in various sizes to fit snugly over the top portion of various sized women having various sized torsos and arms. In one example of an implementation, the garment accessory 100, 200, 300 and 400 is made entirely of a four-way stretch material, with added stretch trims and elastic encircling the torso under the bust, and optionally around the bottoms of the sleeves. When the garment accessory fits snugly, the garment accessory may have the ability to support the breasts due to the stretch fabric and cut of the design, and therefore, may be worn either with or without a bra, at the discretion of the wearer.

In particular, FIG. 1 is a front perspective view of one example of a reversible sleeved garment accessory 100 illustrating the garment accessory 100 with the low-cut side 102 of the garment accessory in the front and the full coverage side 104 in the back. As illustrated in FIG. 1, the reversible garment accessory 100 is constructed at least partially from an elastic material permitting the garment to stretch. The reversible garment accessory 100 includes a first face 102 and a second face 104 forming a circular upper torso member and further consisting of two opposing sleeves or sleeve members 106 extending therefrom. The first face 102 is designed to provide minimal coverage for a wearer and the second face 104 is designed to provide fuller coverage, such that the garment accessory 100 can be worn with either the first face 102 or the second face 104 facing forward over the chest of the wearer to conceal the garment accessory 100 under an overlying garment, as desired, depending upon the neckline cut of the overlying garment.

As further illustrated in FIG. 1, the garment accessory 100 further includes an elastic band member 110 designed to encircle the torso of the wearer just underneath the chest of the wearer. The elastic band member 110 may be a one piece elastic member that is permanently affixed at opposing ends through stitching to create a unitary elastic band 110 encircling the torso. As a unitary band 110, in the illustrated implementation, the wearer would be required to pull the garment over one's head or step into the garment.

Figure 4:
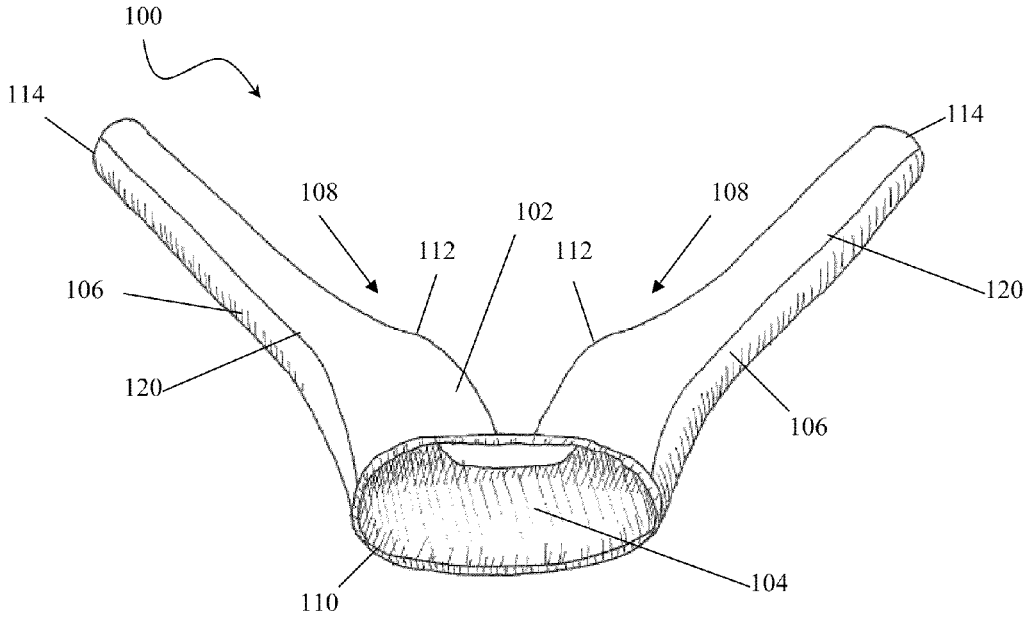
FIG. 4 is a bottom perspective view of the reversible sleeved garment accessory of FIG. 1 illustrating the arms of the garment extended vertically upward.
Figure 5:
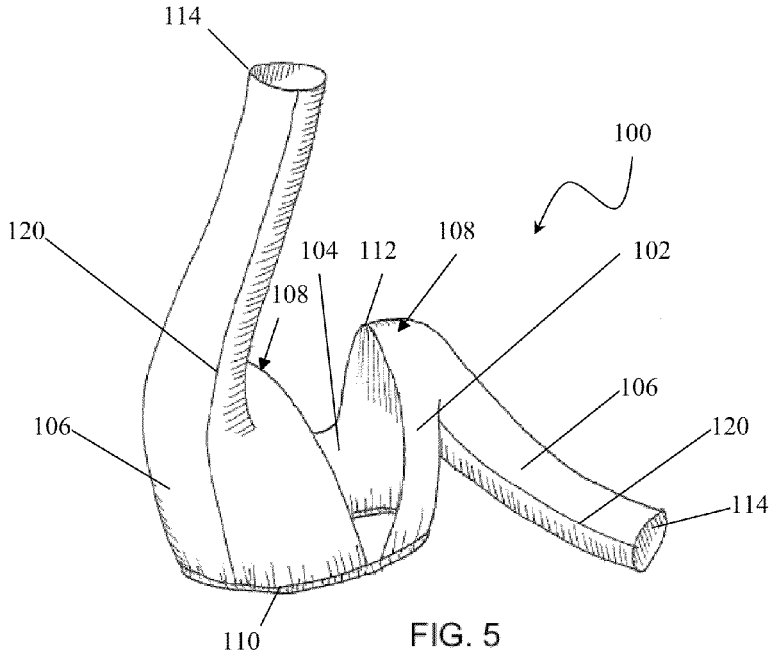
FIG. 5 is a side perspective view of the reversible sleeved garment accessory of FIG. 1 illustrating the rearward arm of the garment extending horizontally outward from the front of the garment and the forward arm extending vertically upward.

To provide the appearance that the garment accessory 100 is part of an overlying garment 3100, 3500 (see FIGS. 31-35), when worn together, the garment accessory 100 is made so it has no shoulder seam along the shoulder portion 108 of the arms or along the upper side of the arms 106 themselves. The garment accessory 100 is all one piece from the neckline 112 to the opposing end of the sleeve 114 (which may extend to a wearer's wrist or be shorter depending upon sleeve length (e.g., the sleeve end portion may terminate mid-arm when designed to be a ¾ or shorter length sleeve)), and curving down under the bust 116 portion of the garment to the bottom of the bra-line and across the back 118 of the garment, creating the illusion of being part of the original dress, top or garment. As illustrated in FIGS. 4 and 5, all the seams 120 are made under the arms and along the undersides of the garment to substantially conceal the seams 120.

Figure 2:
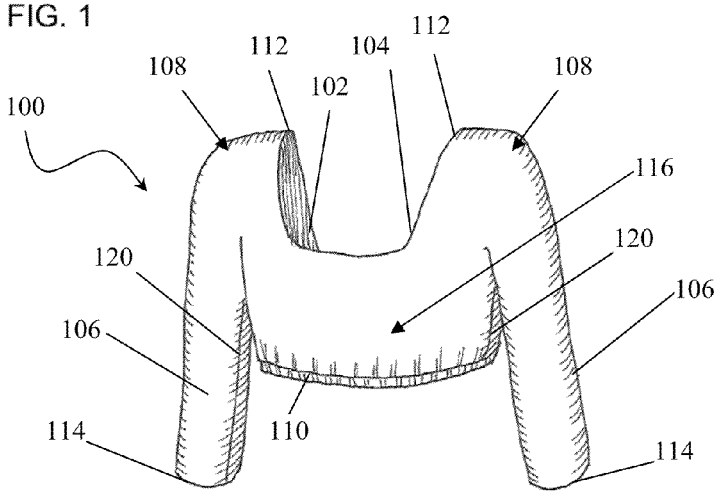
FIG. 2 is a rear perspective view of the reversible sleeved garment accessory of FIG. 1.

FIG. 2 is a rear perspective view of the reversible sleeved garment accessory 100 of FIG. 1. As explained above, the garment accessory 100 is cut differently on one side (i.e., the front face 102) than on the other side (i.e., the back face 104) to create two different wearing options. In this manner, the garment accessory 100 may be worn frontward or backward for two different looks, each with two different levels of coverage. As shown in FIG. 1, one side or the front face 102 it is cut very low and is open down to the bottom of the bust where the elastic 110 encircles the torso, leaving the center of the bust, chest and neckline open, yet still has the stretchy material sewn from the bottom of the elastic on each side covering the arms, underarms, shoulder and sides of the chest and torso. The other side, or the second face 104, has the same stretchy fabric, yet cut higher to cover either a portion of the wearer's back if worn in the back, or if worn in the front, to cover the woman's cleavage, spanning across the top of the torso from sleeve to sleeve.

Figure 3:
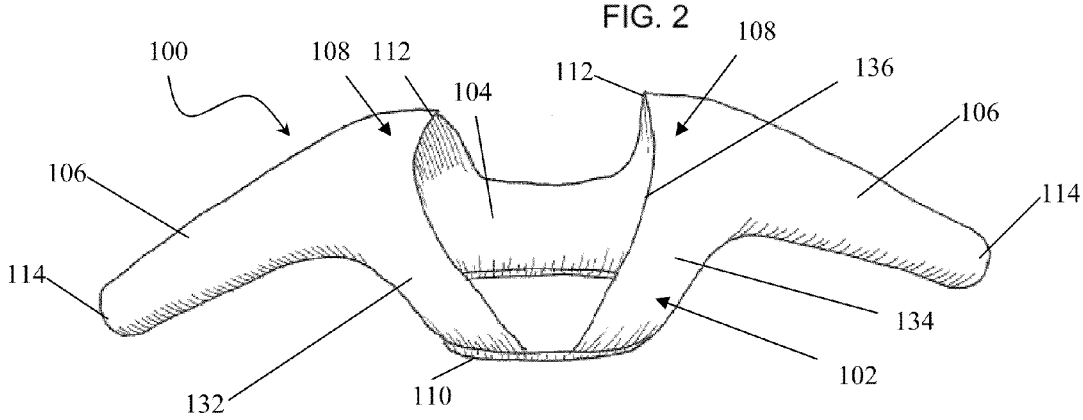
FIG. 3 is a top perspective view of the reversible sleeved garment accessory of FIG. 1 illustrating the arms of the garment extended horizontally outward.

FIG. 3 is a top perspective view of the reversible sleeved garment accessory 100 of FIG. 1 illustrating the arms 106 of the garment extended horizontally outward. FIG. 3 illustrates the garment accessory 100 having no shoulder seam along the shoulder portion 108 of the arms or along the upper side of the arms 106 themselves. FIG. 3 further highlights that the garment accessory 100 is constructed from one piece from the neckline 112 to the opposing end of the sleeve 114, curving down and forming the first face and across the back forming the second face 104.

As illustrated in FIG. 3, the first face 102 and a second face 104 are formed from a single cut of fabric to avoid seams along the shoulder and upper arm portions. Further, in the illustrated example, the first face 102, or low-cut side 102 is formed from the joining of two corresponding halves 132 and 134. To construct the garment accessory, the sleeves 106 and sides of the garment accessory 100 are then formed to by joining the sleeve 106 portion of the fabric by a seam 120 located on the underside of the sleeves that extends to along the sides (see FIGS. 4 and 5). The first face 102 and second face 104 are then designed to encircle the torso by attachment to the elastic band 110, which may or may not include a closure device 240 (see FIG. 15). Alternatively, the first face 102 and a second face 104 may be formed from two reverse cuts of fabric, in which case, both the first face 102 and second face 104 may include opposing halves, similar to the halves 132 and 134, which may be joined together at the elastic band 110. In this case, the halves may be joined to cross-over, as illustrated in connection with FIGS. 17 and 18 below. Further, the neckline 136 created by the first face 102 and second face 104 may further include elastic trim. Similarly, elastic trim may be placed at the ends 114 of the sleeves 106.

FIG. 4 is a bottom perspective view of the reversible sleeved garment accessory 100 of FIG. 1 illustrating the arms 106 of the garment extended vertically upward. FIG. 4 best illustrates that all the seams 120 are made under the arms 106 and along the side of garment accessory 100 to substantially conceal the seams 120 when worn.

FIG. 5 is a side perspective view of the reversible sleeved garment accessory 100 of FIG. 1 illustrating the rearward arm 106 of the garment accessory 100 extending horizontally outward from the front of the garment accessory 100 and the forward arm 106 extending vertically upward. Like FIG. 4, FIG. 5 illustrates the seams 120 on the garment accessory 100 positioned on the underside of the arms 106 and sides of the garment accessory 120 to conceal the seams when worn and create the appearance that the garment accessory 120 is part of the garment with which it is worn.

Figure 6:
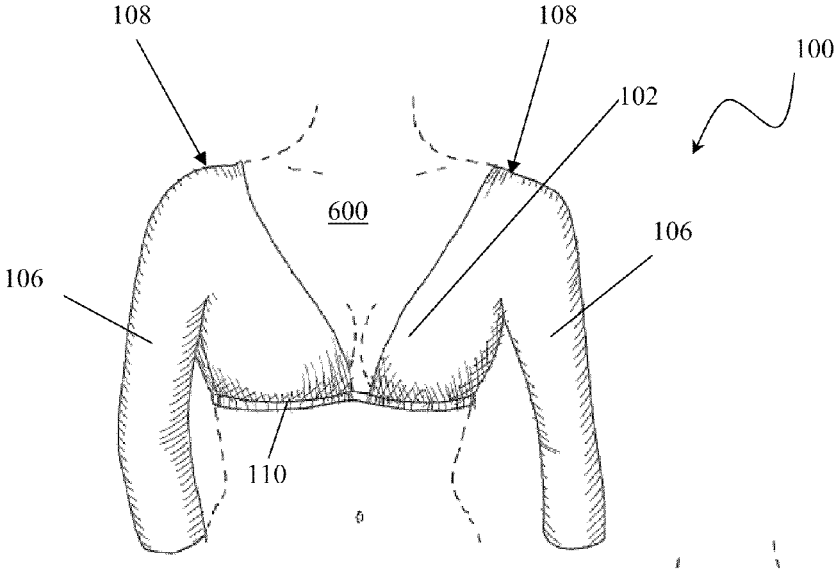
FIG. 6 is a front view of the reversible sleeved garment accessory of FIG. 1 illustrating the garment accessory being worn with the low-cut side of the garment accessory worn in the front, the full coverage side worn in the back and the shoulder portion of the sleeves of the garment accessory worn on-the-shoulders.

FIG. 6 is a front view of the reversible sleeved garment accessory 100 of FIG. 1 illustrating the garment accessory 100 being worn by a wearer 600 with the low-cut side 102 of the garment accessory 100 worn in the front, and with the full coverage side 104 worn in the back and the shoulder portions 108 of the sleeves 106 of the garment accessory 100 worn on-the-shoulders of the wearer 600. As illustrated in FIG. 6, the lower-cut side or first face 102 of the garment accessory 100, when worn in the front, may be designed to fully or partially expose a woman's cleavage, which may allow the garment accessory 100 to be concealed from the front even when worn with low-cut overlying garments. If worn in the back, the low-cut side may be still be concealed when worn with low or partially open-backed dresses.

Figure 7:
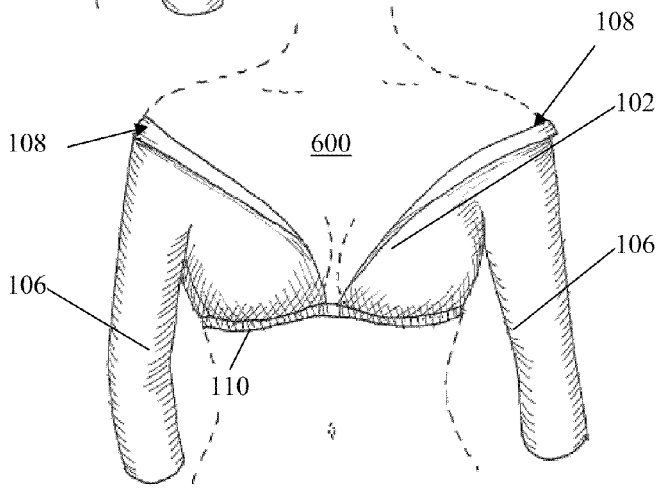
FIG. 7 is a front view of the reversible sleeved garment accessory of FIG. 1 illustrating the garment accessory being worn with the low-cut side in the front and the full coverage side of the garment worn in the back and the shoulder portions of the sleeves worn off-the-shoulders.

FIG. 7 is a front view of the reversible sleeved garment accessory of FIG. 1 illustrating the garment accessory 100 being worn with the low-cut side 102 in the front and the full-coverage side 104 of the garment accessory 100 worn in the back and the shoulder portions 108 of the sleeves 106 folded or rolled down to create an off-the-shoulders look. In particular, when the garment accessory 100 may be made of a stretch or semi-stretch material, with no seam separating the sleeve 106 from the shoulder portions 108 of the garment accessory 100, the garment accessory 100 may be rolled or folded down and off the shoulders of the wearer 600, creating another style when worn off the shoulder either frontward or backward.

Figure 8:
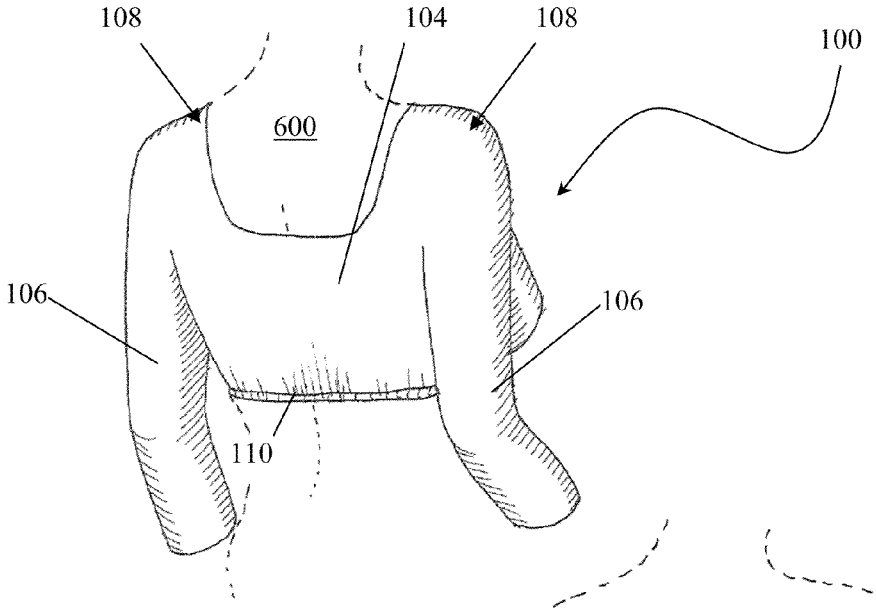
FIG. 8 is a back view of the reversible sleeved garment accessory of FIG. 1 illustrating the garment accessory being worn with the low-cut side of the garment accessory worn in the front, the full coverage side worn in the back and the shoulder portions of the sleeves of the garment accessory worn on-the-shoulders.

FIG. 8 is a back view of the reversible sleeved garment accessory of FIG. 1 illustrating the garment accessory 100 being worn by a wearer 600 with the low-cut side 102 of the garment accessory 100 worn in the front, the full coverage side 104 worn in the back and the shoulder portions 108 of the sleeves 106 of the garment accessory 100 worn on-the-shoulders.

Figure 9:
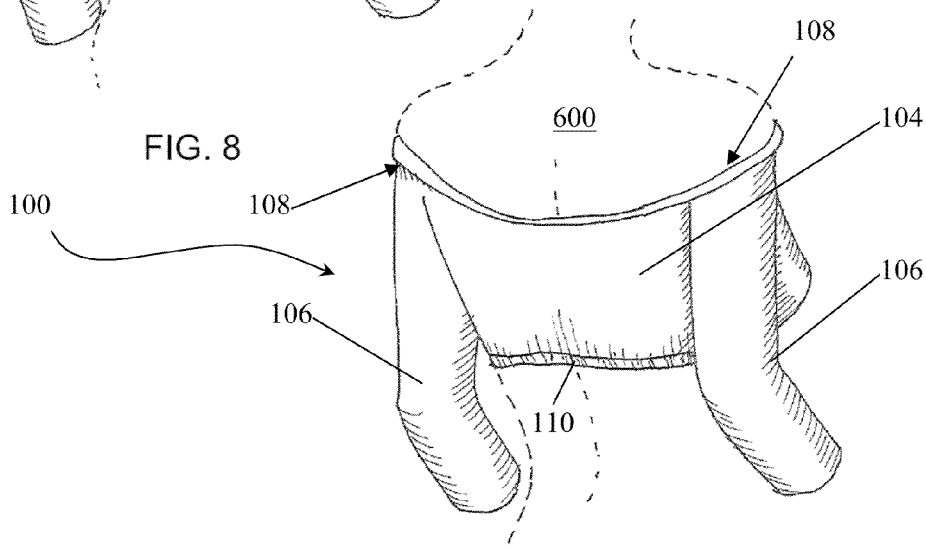
FIG. 9 is a back view of the reversible sleeved garment accessory of FIG. 1 illustrating the garment accessory being worn with the full-coverage side in the front, the low-cut side of the garment worn in the back and the shoulder portions of the sleeves worn off-the-shoulders.

FIG. 9 is a back view of the reversible sleeved garment accessory 100 of FIG. 1 illustrating the garment accessory 100 being worn with the full-coverage side 104 in the back, the low-cut side 102 of the garment accessory 100 worn in the front and the shoulder portions of the sleeves 108 worn off-the-shoulders. In particular, FIG. 9 shows the back view of the wearer 600 of FIG. 7 and further illustrates that when the garment accessory 100 may be made of a stretch or semi-stretch material, with no seam separating the sleeve 106 from the shoulder portions 108 of the garment accessory 100, the garment accessory 100 may be rolled or folded down and off the shoulders of the wearer 600, creating another style when worn off the shoulder either frontward or backward.

Figure 10:
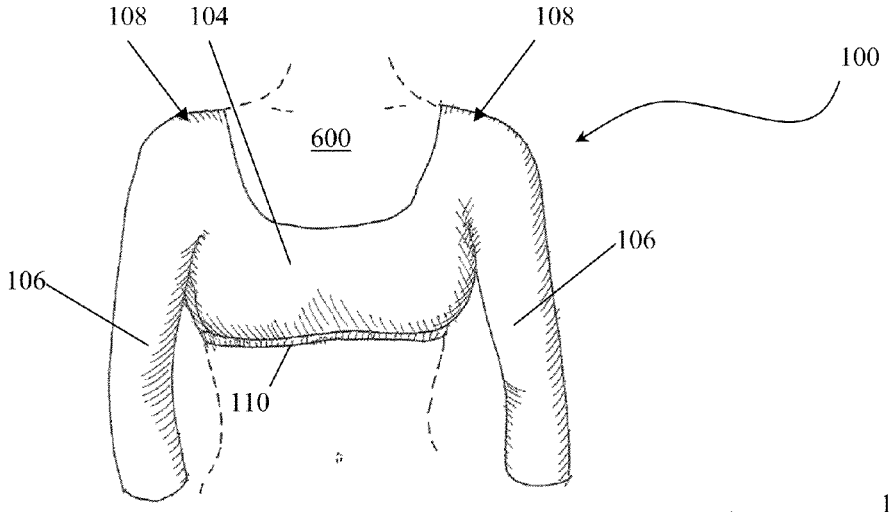
FIG. 10 is a front view of the reversible sleeved garment accessory of FIG. 1 illustrating the garment accessory being worn with the full-coverage side in the front, the low-cut side of the garment worn in the back and the shoulder portion of the sleeves worn on-the-shoulders.

FIG. 10 is a front view of the reversible sleeved garment accessory of FIG. 1 illustrating the garment accessory 100 being worn by a wearer 600 with the full-coverage side 104 in the front, the low-cut side 102 of the garment accessory 104 worn in the back and shoulder portion 108 of the arms 106 worn on-the-shoulders. As illustrated, the fuller coverage side 104 of the garment accessory 100 may be designed to fully cover a woman's cleavage (when the fuller coverage side is worn in the front), yet provide a low neckline that may be concealed, as desired when worn with an overlying garment.

Figure 11:
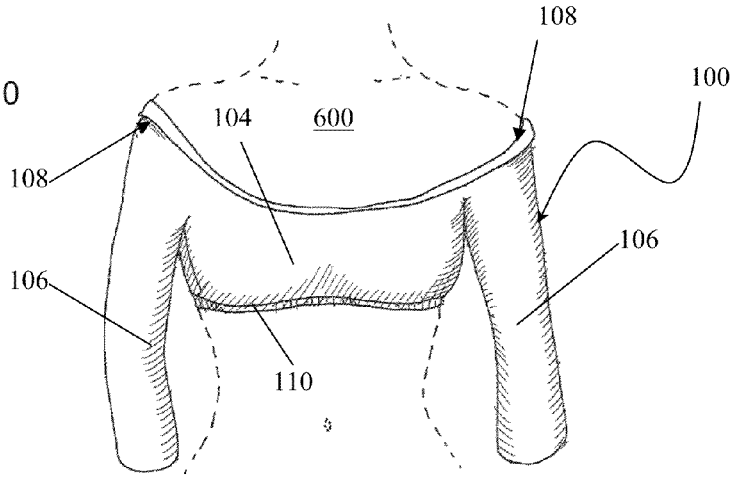
FIG. 11 is a front view of the reversible sleeved garment accessory of FIG. 1 illustrating the garment accessory being worn with the full-coverage side in the front, the low-cut side of the garment worn in the back and the shoulder portion of the sleeves worn off-the-shoulders.

FIG. 11 is a front view of the reversible sleeved garment accessory 100 of FIG. 1 illustrating the garment accessory 100 being worn by a wearer 600 with the full-coverage side

104 in the front, the low-cut side 102 of the garment worn in the back and the shoulder portions 108 of the arms or sleeves 106 worn folded down and off-the-shoulders. FIG. 11, like FIG. 7, further demonstrates the versatility of the garment accessory 100 by showing that the shoulder portions 108 of the arms or sleeves 106 can be folded down when the garment accessory 100 is worn with the full-coverage side 104 in the front, in the same manner as when the low-cut side 102 is worn in the front (see FIG. 7), to create an additional look.

Figure 12:
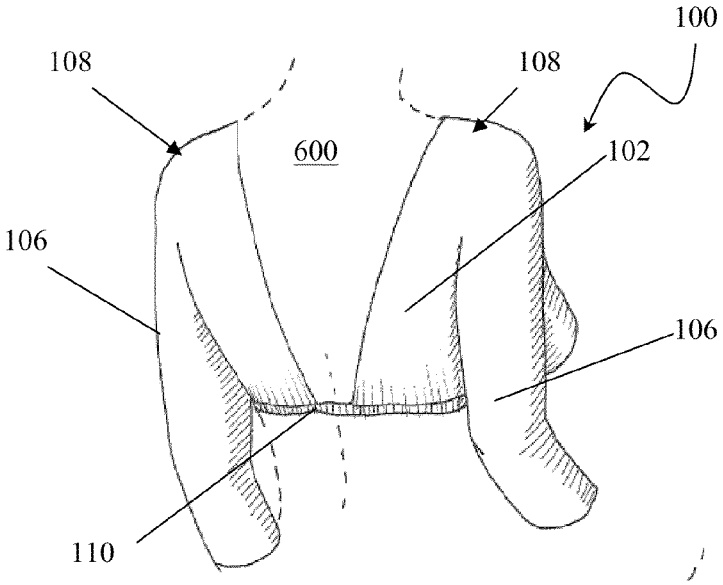
FIG. 12 is a back view of the reversible sleeved garment accessory of FIG. 1 illustrating the garment accessory being worn with the full-coverage side in the front, the low-cut side of the garment worn in the back and the shoulder portion of the sleeves worn on-the-shoulders.
Figure 13:
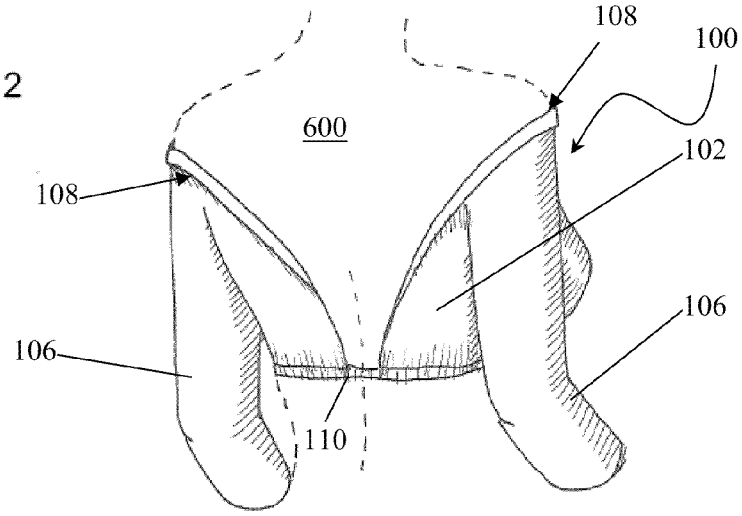
FIG. 13 is a back view of the reversible sleeved garment of FIG. 1 illustrating the garment accessory being worn with the full-coverage side in the front, the low-cut side of the garment worn in the back and the shoulder portion of the sleeves worn off-the-shoulders.

FIG. 12 is a back view of the reversible sleeved garment accessory 100 illustrating the garment accessory 100 being worn by a wearer 600 with the full-coverage side 104 in the front, the low-cut side 102 of the garment accessory 102 worn in the back. Further, in this illustration, the shoulder portions 108 of the sleeves or arms 106 are worn on-the-shoulders. Similarly, FIG. 13 is a back view of the reversible sleeved garment accessory 100 illustrating the garment accessory 100 being worn by a wearer 600 with the full-coverage side 104 in the front, the low-cut side 102 of the garment accessory 100 worn in the back. To create another look, the shoulder portions 106 of the sleeves 108 are folded down and worn off-the-shoulders.

FIGS. 6-13 highlight one example design of the garment accessory 100, as well as the four various ways in which the garment accessory 100 may be worn underneath a garment 100. In particular, FIGS. 6 & 8 illustrate the reversible sleeved garment accessory 100 being worn with the low-cut side 102 of the garment accessory in the front, the full/fuller coverage side 104 worn in the back and the sleeves of the garment accessory worn on-the-shoulders. FIGS. 7 & 9 illustrate the reversible sleeved garment accessory 100 being worn with the low-cut side 102 of the garment accessory in the front, the full/fuller coverage side 104 worn in the back, but with the shoulder portions 108 of the sleeves 106 of the garment accessory 100 worn off-the-shoulders. FIGS. 10-13 then illustrate the garment accessory 100 worn in reverse that shown in FIGS. 6-9, with the shoulder portions 106 of the sleeves 106 both up (FIGS. 10 & 12) and rolled down (FIGS. 11 & 13).

Figure 14:
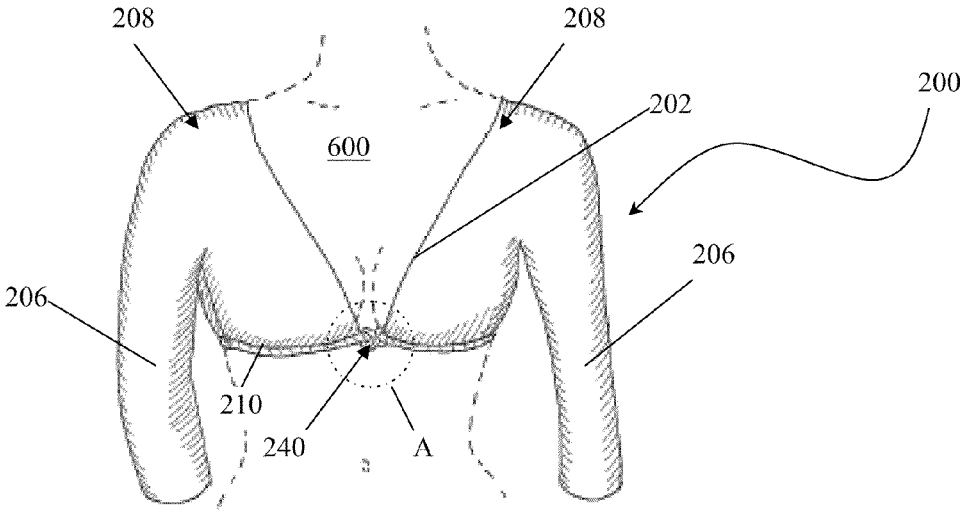
FIG. 14 is a front view of one example of another embodiment of a reversible sleeved garment accessory illustrating the garment accessory being worn with the low-cut side of the garment accessory worn in the front, the full coverage side worn in the back and the shoulder portion of the sleeves of the garment accessory worn on-the-shoulders.

FIG. 14 is a front view of one example of another embodiment of a reversible sleeved garment accessory 200 illustrating the garment accessory 200 being worn by a wearer 600 with the low-cut side 202 of the garment accessory 200 worn in the front and the full coverage side 204 (not shown) worn in the back. Alternatively to the elastic band 210 being permanently affixed together to encircle the body of the wearer 600, as illustrated in FIGS. 1-13, the elastic band 210 of the garment accessory 200 may be removably secured together utilizing a clip, clasp, hooks, or other closure or fastening mechanism know by those skilled in the art. In the example shown in FIG. 14, the garment accessory 200 is designed to have clasp 240 attached to the elastic band 210 that encircles the wearer's torso just under the bust of the wearer on the low-cut side 202 of the garment accessory 200. In this manner, by utilizing a clasp 240 to removeably fasten the elastic band 210, the garment accessory 200 may open and close for the wearer 600 to slip more easily on and off. As with the garment accessory 200 itself, the clasp 240 is made to be flat and secured just under the cleavage of the wearer 600 when the low-cut side is worn in the front such that the clasp 240 lies flat under the woman's garment to give a smooth look that appears to be part of the overlying outfit.

Figure 15:
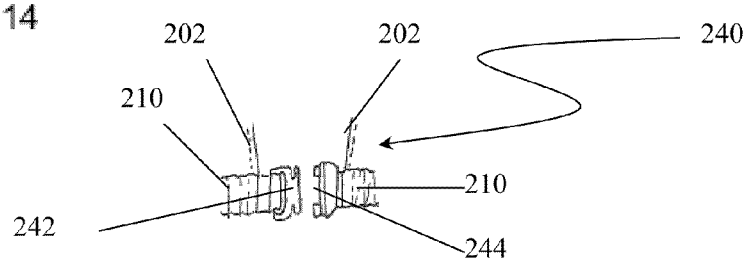
FIG. 15 is an enlarged view of the closure device illustrated in Section A of FIG. 14.

FIG. 15 is an enlarged view of the clasp 240 illustrated in Section A of FIG. 14 showing the clasp 240 in the open position. As illustrated, the clasp 240 is a closure device having mating cooperative portions 242 and 244 commonly known in the art. One end of the elastic band 210 is affixed to one mating portion 242, while the other end of the mating portion 244 is affixed to the opposing end of the elastic band 210. The front face 202 is separated in two halves at or near the closure device 240, with one half of the front face 202 extending from one side of the elastic band 210 and the other half of the front face 202 extending from the other side of the elastic band 210 opposite the closure device 240.

Figure 16:
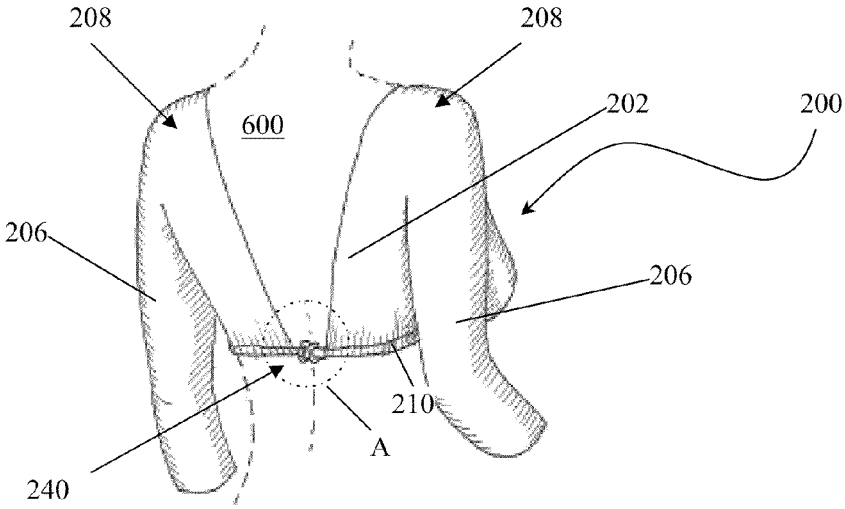
FIG. 16 is a back view of the reversible sleeved garment accessory of FIG. 14, illustrating the garment accessory being worn in reverse to that illustrated in FIG. 14, with the low-cut side of the garment accessory worn in the back and the full coverage side worn in the front.

FIG. 16 is a back view of the reversible sleeved garment accessory 200 of FIG. 14, illustrating the garment accessory 200 being worn in reverse to that illustrated in FIG. 14, with the low-cut side of the garment accessory worn in the back. In this implementation, the low-cut side 202 is separated with a closure device 240, such as a hook or clasp, that permits the wearer to open and close the garment accessory 200 for ease in dressing and undressing when wearing the garment accessory 200.

Figure 17:
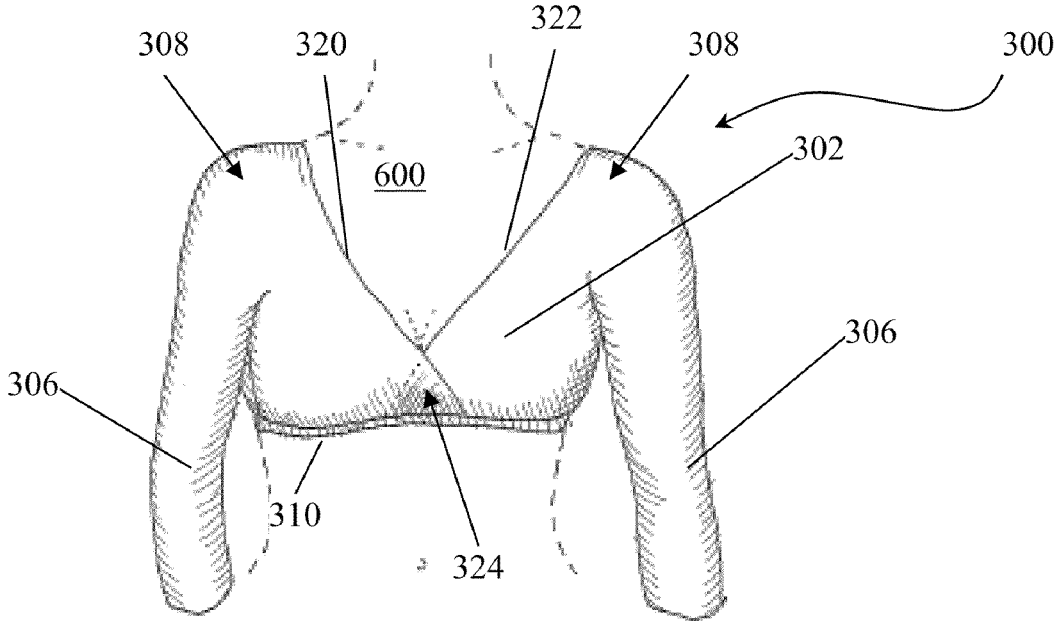
FIG. 17 is a front view of yet another example of another implementation of a reversible sleeved garment accessory illustrating the garment accessory being worn with an alternative design low-cut side of the garment accessory worn in the front, the full coverage side worn in the back and the shoulder portion of the sleeves of the garment accessory worn on-the-shoulders.

FIG. 17 is a front view of yet another example of another implementation of a reversible sleeved garment accessory 300 illustrating the garment accessory 300 being worn with the low-cut side 302 of the garment accessory 300 worn in the front. In this example, the garment accessory 300 has a cross-over feature on at least one side of the garment accessory where the material spans from the shoulder portion 308 and across the bust or back, forming a v-neckline that can be as open or closed as the wearer determines by leaving it as is, or by discreetly pinning it more closed. As illustrated, when the cross-over feature is provided on the low-cut side 302, each half 320 and 322 overlap one another near the elastic band 310 creating a triangular overlay section 324, having double thickness material.

Figure 18:
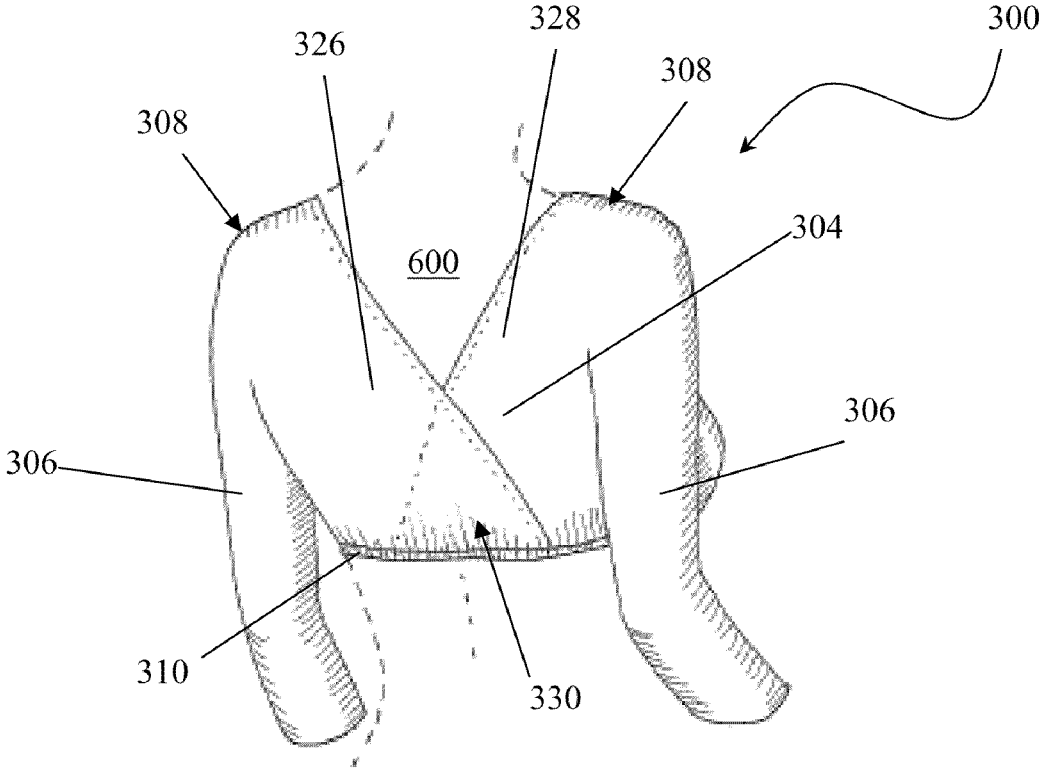
FIG. 18 is a back view of still another example of an implementation of a reversible sleeved garment accessory, illustrating the garment accessory being worn with an alternative design and the full coverage side worn in the back of the garment.

The same cross-over feature can be provided on the fuller coverage side 304 of the garment accessory 300. As illustrated in FIG. 18, the full coverage side 304, which in this illustration is shown worn on the back of the wearer, may further include each half 326 and 328 of the full coverage side 304 overlap one another near the elastic band 310 creating a triangular overlay section 330, having double thickness material. While the cross-over feature can be designed to be on either or both the low-cut 302 or full-coverage 304 side of the garment accessory 300, the cross-over feature may only be utilized on one side 302, 304 of the garment accessory 300. For example, when the cross-over feature is on the low-cut side 302 of the garment accessory 300, the fuller coverage side 304 may be designed to have a neckline similar to the full coverage side 104 in FIG. 2. Similarly, when the cross-over feature is on the full coverage side 304, the low-cut side 302 may be similar in design to the low-cut side 102 illustrated in FIG. 1 and may include an elastic band with or without a closure device 240 (FIG. 15).

Figure 19:
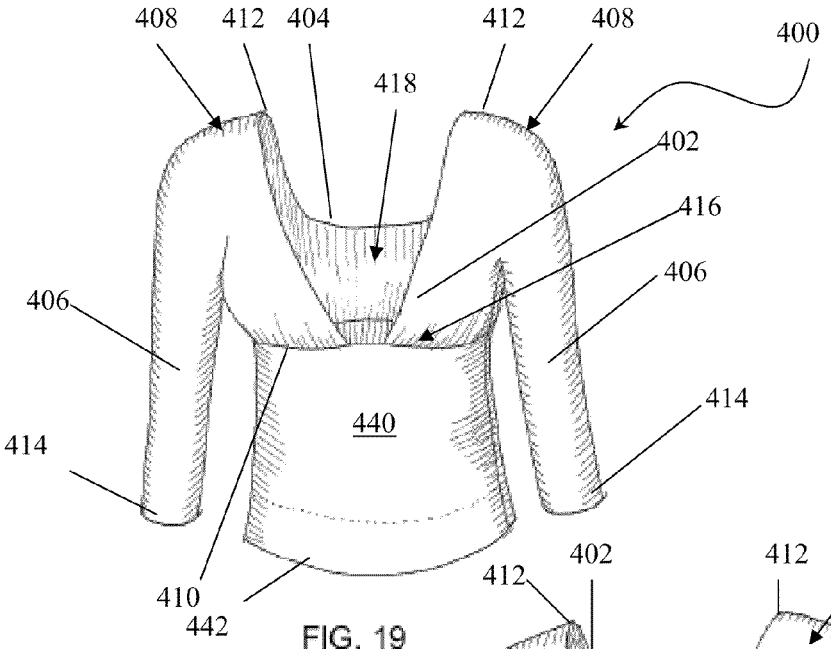
FIG. 19 is a front perspective view of yet another example of a reversible sleeved garment accessory of the invention illustrating the garment accessory with the low-cut side of the garment accessory in the front and the full coverage side in the back.

FIG. 19 is a front perspective view of yet another example of a reversible sleeved garment accessory 400 of the present invention illustrating the garment accessory 400 with the low-cut side of the garment accessory in the front and the full coverage side in the back. The garment accessory 400 is similar in construction to that illustrated in FIG. 1, yet includes a bodice or torso section 440 extending below the elastic band 410 of the garment accessory and, in some designs, the bodice section 440 replaces the elastic band 410 in its entirety. The bodice section 440 terminates at hem 442, which may extend to the waist or below the waist of the wearer.

Similar to the design in FIG. 1, the garment accessory 400 includes a low-cut side 402 and a full coverage side 404, is reversible and can be worn both with the shoulder portions 408 up or rolled down. The reversible garment accessory further includes two opposing sleeve members 406. The first face 402 is designed to provide minimal coverage for a wearer and the second face 404 is designed to provide fuller coverage, such that the garment accessory 400 can be worn with either the first face 402 or the second face 404 facing forward over the chest of the wearer to conceal the garment accessory 400 under an overlying garment, as desired, depending upon the neckline cut of the overlying garment.

In this implementation, the garment accessory 400 may further includes an elastic band member 410 designed to encircle the torso of the wearer just underneath the chest of the wearer. The elastic band member 110 may be a one piece elastic member that is permanently affixed at opposing ends through stitching to create a unitary elastic band 110 encircling the torso. As a unitary band 110, in the illustrated implementation, the wearer would be required to pull the garment over one's head or to step into the garment.

In addition to, or in lieu of, the elastic band member 410 is a form fitting bodice section 440 that may provide shape or support to that of the wearer. The bodice section 440 may be made out of a strong material, such as a blend of nylon and spandex, that are designed to contour the wearer's body to the design of bodice section 440, creating a slimmer body shape. Like the upper portion of the garment accessory, the bodice section 440 is designed to be undetectable under clothing and is designed to have a utilitarian style, similar to the top or upper portion of the garment accessory.

Figure 22:
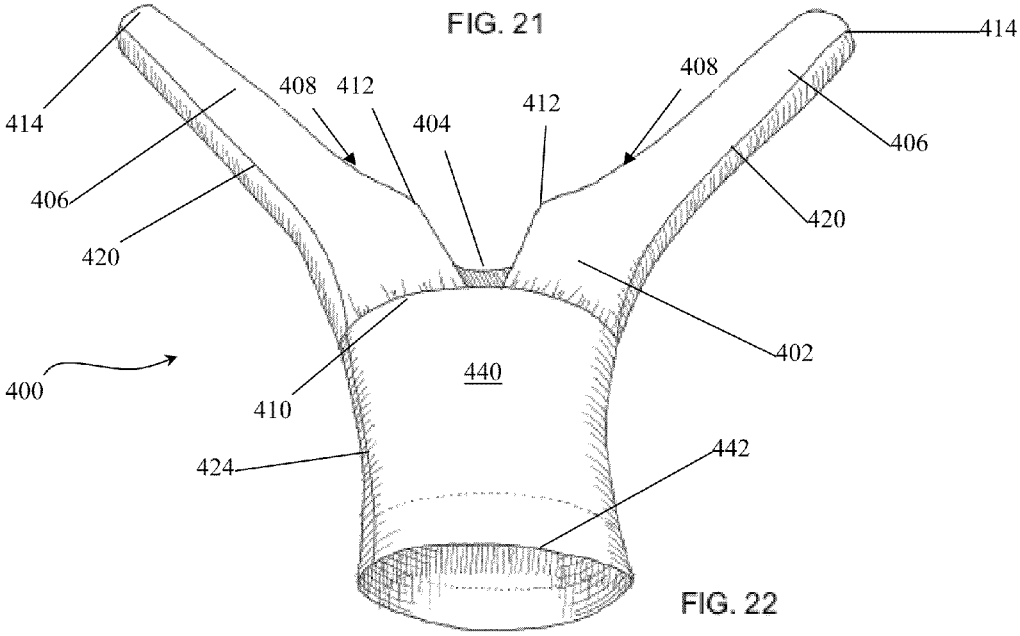
FIG. 22 is a bottom perspective view of the reversible sleeved garment accessory of FIG. 19 illustrating the arms of the garment extending vertically upward.
Figure 23:
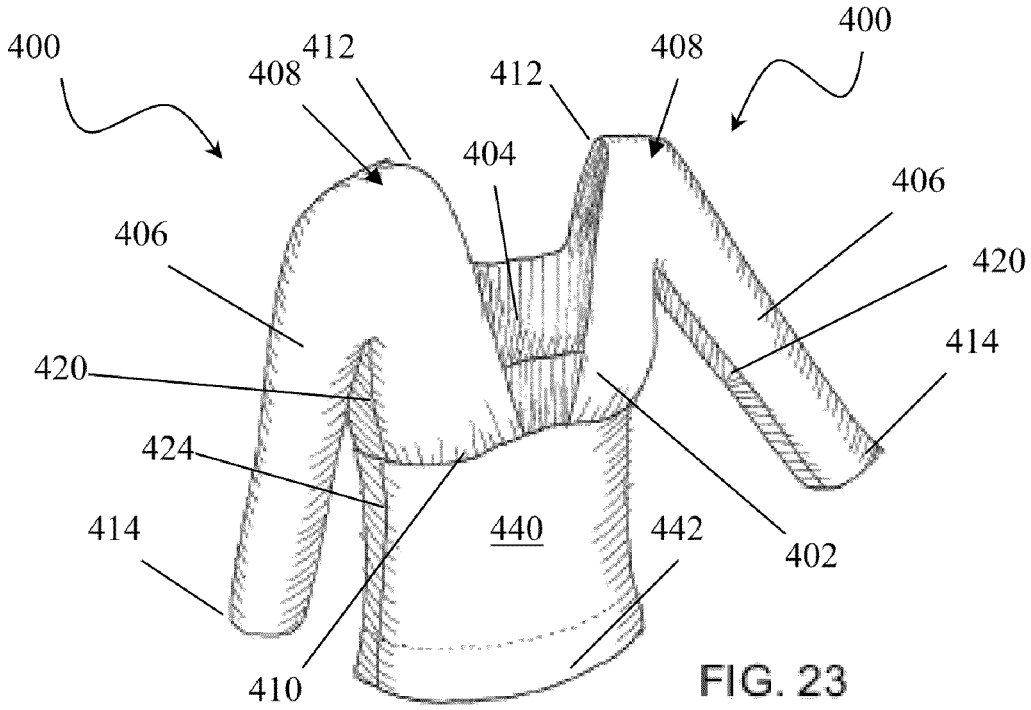
FIG. 23 is a side perspective view of the reversible sleeved garment accessory of FIG. 19 illustrating the rearward arm of the garment extending horizontally outward from the front of the garment.
Figure 24:
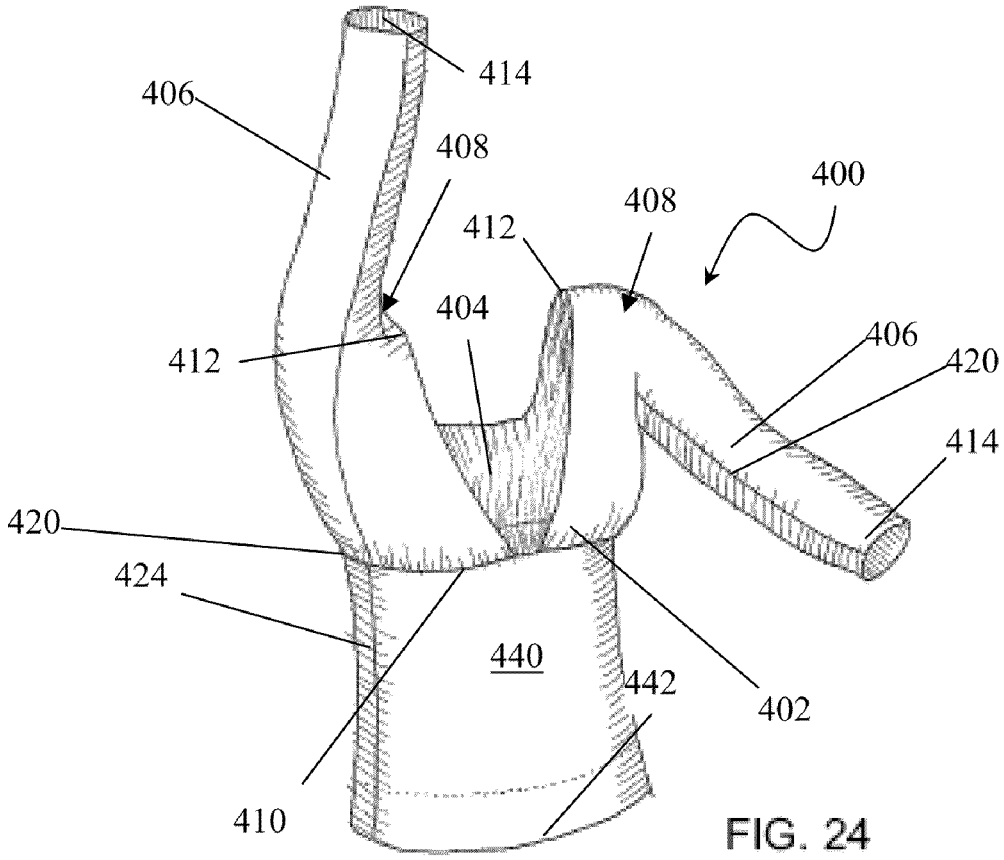
FIG. 24 is a side perspective view of the reversible sleeved garment accessory of FIG. 19 illustrating the rearward arm of the garment extending horizontally outward from the front of the garment and the forward arm extending vertically upward.

To provide the appearance that the garment accessory 400 is part of an overlying garment, when worn together, the garment accessory 400 has no shoulder seam along the shoulder portion 408 of the arms or along the upper side of the arms 406 themselves. The garment accessory 400 is all one piece from the neckline 412 to the opposing end of the sleeve 414 (which may extend to a wearer's wrist or be shorter depending upon sleeve length (e.g., the sleeve end portion may terminate mid-arm when designed to be a ¾ or shorter length sleeve)), and curving down under the bust 416 portion of the garment to the bottom of the bra-line and across the back 418 of the garment, creating the illusion of being part of the original dress, top or garment. As illustrated in FIGS. 22-24, all the seams 420 are made under the arm to substantially conceal the seams.

Figure 20:
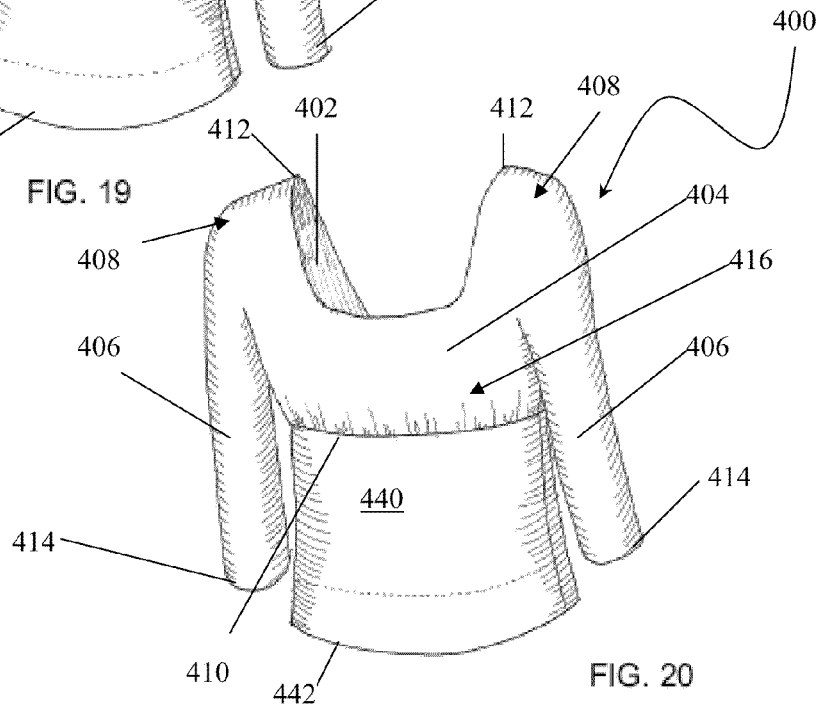
FIG. 20 is a rear perspective view of the reversible sleeved garment accessory of FIG. 19 illustrating the garment accessory.
Figure 21:
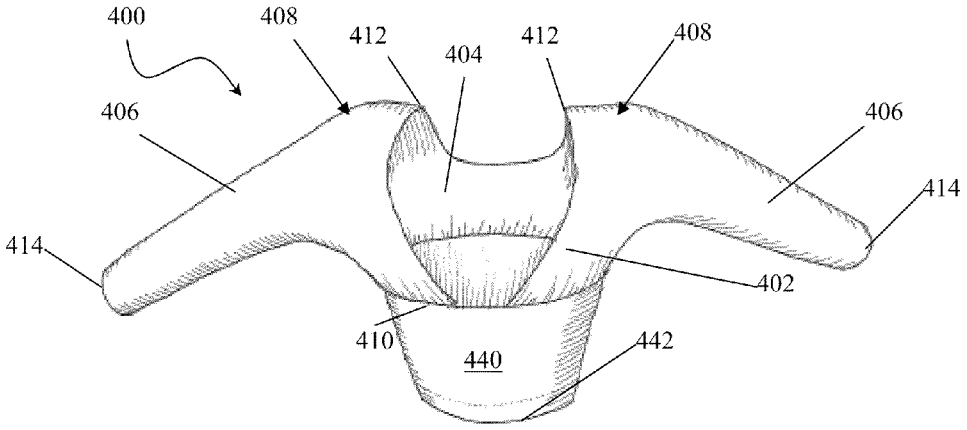
FIG. 21 is a top perspective view of the reversible sleeved garment accessory of FIG. 19 illustrating the arms of the garment extending horizontally outward.

FIG. 20 shows a rear perspective view of the reversible sleeved garment accessory 400 of FIG. 19. This view illustrates the full-coverage side 404. As explained above, the garment accessory 400 is cut differently on one side (i.e., the front face 402) than on the other side (i.e., the back face 404) to create two different wearing options. In this manner, the garment accessory 400 may be worn frontward or backward for two different looks, each with two different levels of coverage. As shown in FIG. 19, one side of the front face 402 is cut very low and is open down to the bottom of the bust where the elastic 410 and/or bodice section 440 encircles the torso, leaving the center of the bust, chest and neckline open, yet still has the stretchy material sewn from the bottom of the elastic on each side covering the arms, underarms, shoulder and sides of the chest and torso. The second face 404, as shown in FIG. 20, is made of the same fabric as the first face 402, yet cut higher to cover either a portion of the wearer's back if worn in the back, or if worn in the front, to cover the woman's cleavage, spanning across the top of the torso from sleeve to sleeve.

FIGS. 21-24 illustrate the garment accessory 400 having no shoulder seam along the shoulder portion 408 of the sleeves along the upper side of the sleeves or arms 406. All of the seams 420 and 424 on the garment are located under the sleeves 406 or along the sides of the garment accessory 400. When the garment accessory 400 includes a bodice portion 440, the seams 424 of the bodice portion 440 may run along one or more sides of the bodice portion 440 in a manner corresponding to the garment accessory seams 420.

Figure 25:
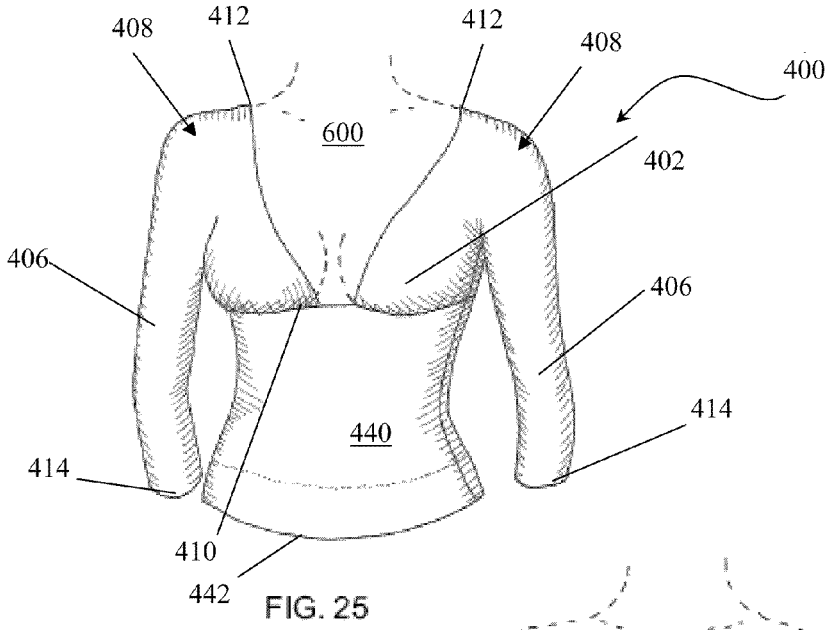
FIG. 25 is a front view of the reversible sleeved garment accessory of FIG. 19 illustrating the garment accessory being worn by a wearer with the low-cut side of the garment accessory worn in the front, the full coverage side worn in the back and the shoulder portion of the sleeves of the garment accessory worn on-the-shoulders.

FIG. 25 is a front view of the reversible sleeved garment accessory 400 illustrating the garment accessory 400 being worn by a wearer 600 with the low-cut side 402 of the garment accessory 400 worn in the front, and with the full coverage side 404 (not shown) worn in the back and the shoulder portions 408 of the sleeves 406 of the garment accessory 400 worn on-the-shoulders of the wearer 600. As illustrated in FIG. 25, the lower-cut side or first face 402 of the garment accessory 400, when worn in the front, may be designed to fully or partially expose a woman's cleavage, which may allow the garment accessory 400 to be concealed from the front even when worn with low-cut overlying garments. If worn in the back, the low-cut side 402 may be still be concealed when worn with low or partially open-backed dresses.

Figure 26:
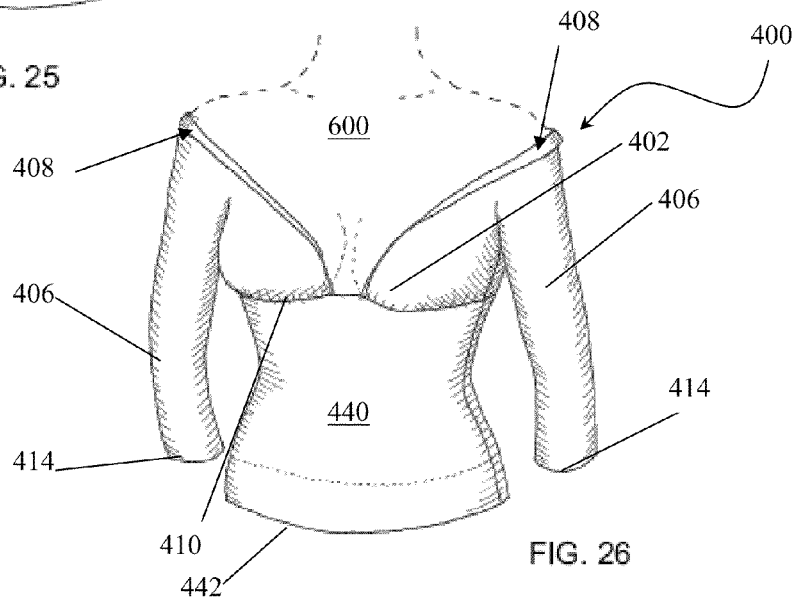
FIG. 26 is a front view of the reversible sleeved garment accessory of FIG. 19 illustrating the garment accessory being worn with the low-cut side in the front and the full coverage side of the garment worn in the back and the shoulder portion of the shoulder portion of the sleeves worn off-the-shoulders.

FIG. 26 is a front view of the reversible sleeved garment accessory 400 illustrating the garment accessory 400 being worn by a wearer 600 with the low-cut side 402 in the front and the full-coverage side 404 (not shown) of the garment accessory 400 worn in the back and the shoulder portions 408 of the sleeves 406 folded or rolled down to create an off-the-shoulders look. In particular, when the garment accessory 400 may be made of a stretch or semi-stretch material, with no seam separating the sleeve 406 from the shoulder portions 408 of the garment accessory 400, the garment accessory 400 may be rolled or folded down and off the shoulders of the wearer 600, creating another style when worn off the shoulder either frontward or backward.

Figure 27:
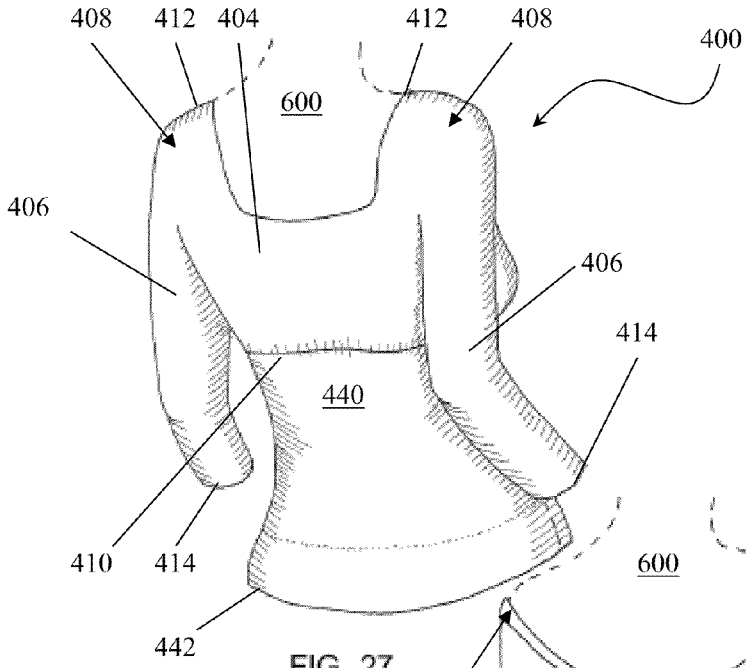
FIG. 27 is a back view of the reversible sleeved garment accessory of FIG. 19 illustrating the garment accessory being worn with the low-cut side of the garment accessory worn in the front, the full coverage side worn in the back and the shoulder portion of the sleeves of the garment accessory worn on-the-shoulders.
Figure 28:
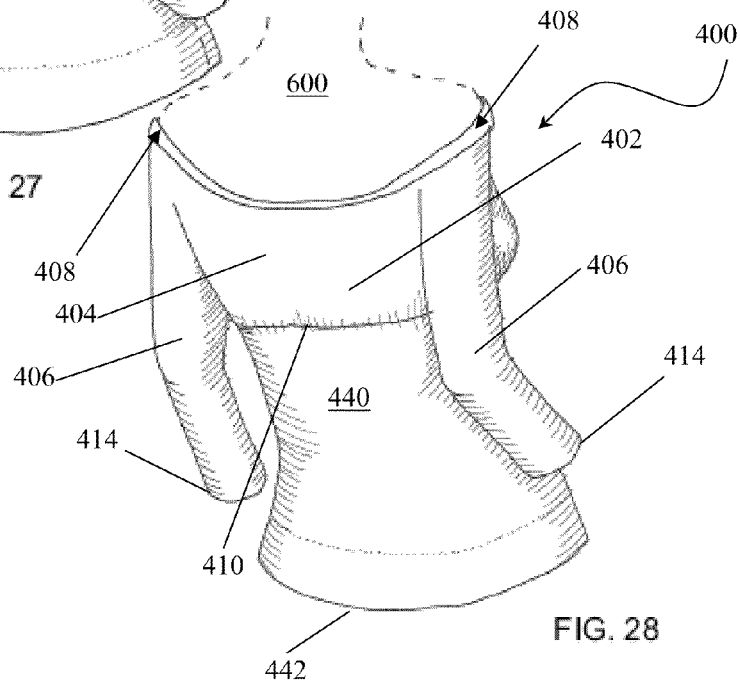
FIG. 28 is a back view of the reversible sleeved garment accessory of FIG. 19 illustrating the garment accessory being worn with the low-cut side in the front, the full coverage side of the garment worn in the back and the shoulder portion of the sleeves worn off-the-shoulders.

FIG. 27 is a back view of the reversible sleeved garment accessory 400 illustrating the garment accessory 400 being worn by a wearer 600 with the low-cut side 402 (not shown) of the garment accessory 400 worn in the front, the full coverage side 404 worn in the back and the shoulder portions 408 of the sleeves 406 of the garment accessory 400 worn on-the-shoulders. Similarly, FIG. 28 is a back view of the reversible sleeved garment accessory 400 illustrating the garment accessory 400 being worn with the full-coverage side 404 in the back, the low-cut side 402 of the garment accessory 400 worn in the front and the shoulder portions of the sleeves 408 worn off-the-shoulders.

Figure 29:
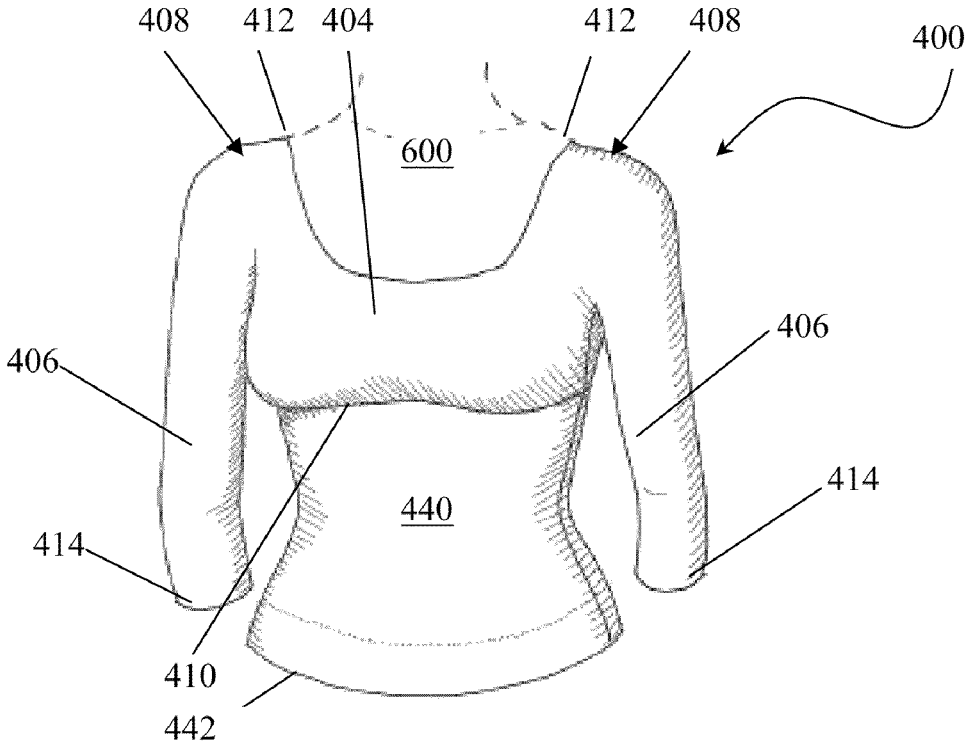
FIG. 29 is a front view of the reversible sleeved garment accessory of FIG. 19 illustrating the garment accessory being worn with the full-coverage side in the front, the low-cut side of the garment worn in the back and the shoulder portion of the sleeves worn on-the-shoulders.

FIG. 29 is a front view of the reversible sleeved garment accessory 400 illustrating the garment accessory 400 being worn by a wearer 600 with the full-coverage side 404 in the front and shoulder portion 408 of the arms 406 worn on-the-shoulders. As illustrated, the fuller coverage side 404 of the garment accessory 400 may be designed to fully cover a woman's cleavage (when the fuller coverage side is worn in the front), yet provide a low neckline that may be concealed, as desired when worn with an overlying garment.

Figure 30:
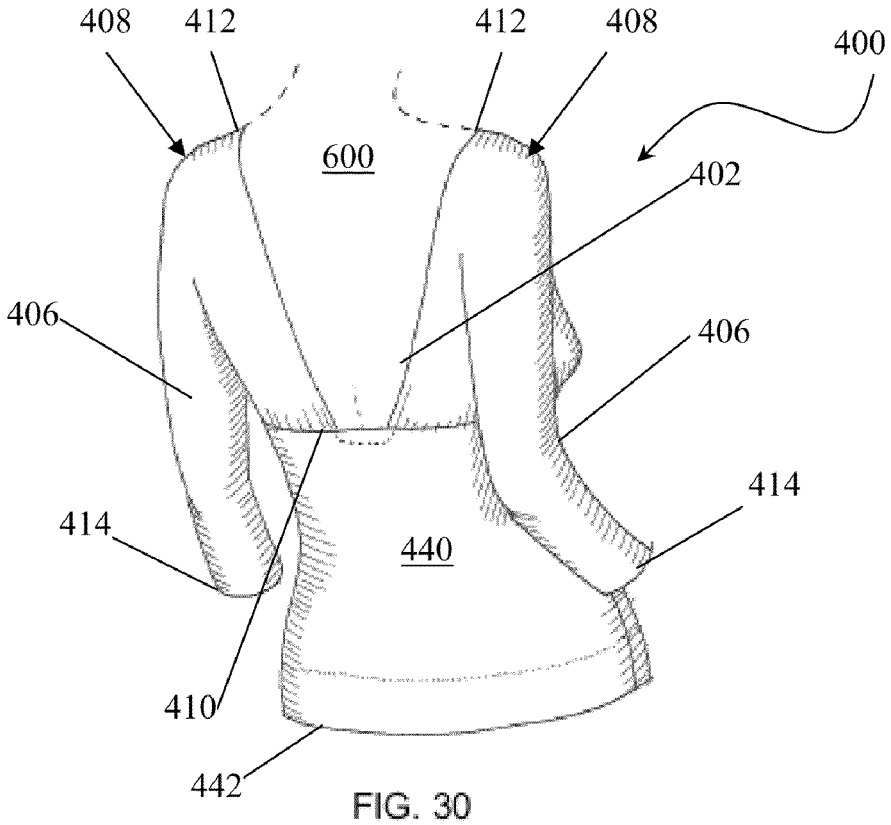
FIG. 30 is a back view of the reversible sleeved garment accessory of FIG. 19 illustrating the garment accessory being worn with the full-coverage side in the front, the low-cut side of the garment worn in the back and the shoulder portion of the sleeves worn on-the-shoulders.

FIG. 30 is a back view of the reversible sleeved garment accessory 400 illustrating the garment accessory 400 being worn by a wearer 600 with the full-coverage side 404 (not shown) in the front, the low-cut side 402 of the garment accessory 400 worn in the back. While in this illustration, the shoulder portions 408 of the sleeves or arms 406 are worn on-the-shoulders, it recognized that, to create another look, the shoulder portions 406 of the sleeves 408 may be folded down and worn off-the-shoulders.

Like with FIGS. 6-13, FIGS. 25-30 highlight the four various ways in which the garment accessory 400 may be worn underneath a garment. In particular, FIGS. 25 & 27 illustrate the reversible sleeved garment accessory 400 being worn with the low-cut side 402 of the garment accessory 400 in the front, the full/fuller coverage side 404 worn in the back and the sleeves of the garment accessory 400 worn on-the-shoulders. FIGS. 26 & 28 illustrate the reversible sleeved garment accessory 400 being worn with the low-cut side 402 of the garment accessory in the front, the full/fuller coverage side 404 worn in the back, but with the shoulder portions 408 of the sleeves 406 of the garment accessory 400 worn off-the-shoulders. FIGS. 29-30 then illustrate the garment accessory 400 worn in reverse. While FIGS. 29-20 only illustrate the shoulder portions 408 of the sleeves 406 up, it is recognized that the shoulder portions 408 of the sleeves 406 may also be folded downward when the full coverage face 404 is worn forward, similar to shown in FIGS. 11 & 13 above.

Figure 31:
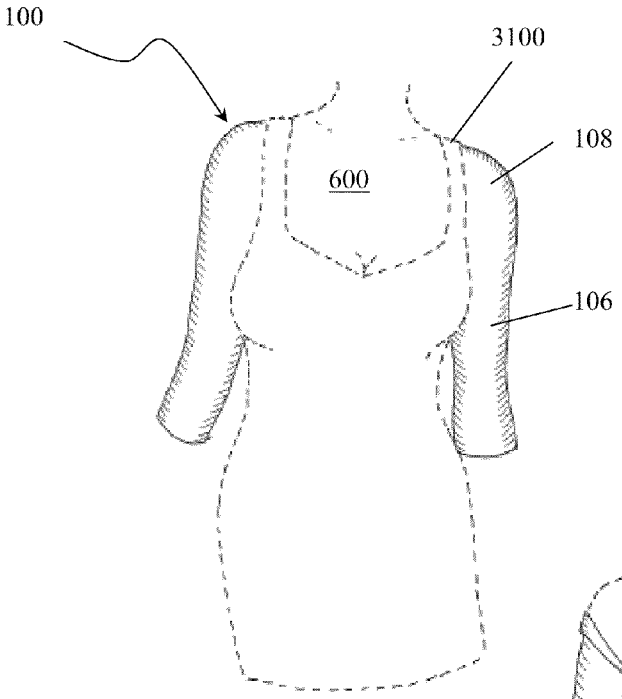
FIG. 31 is a front view of one example of a reversible sleeved garment of the present invention worn underneath a sleeveless dress, illustrating the garment accessory being worn with the low-cut side of the garment accessory worn in the front, the full coverage side worn in the back and the shoulder portion of the sleeves of the garment accessory worn on-the-shoulders.
Figure 32:
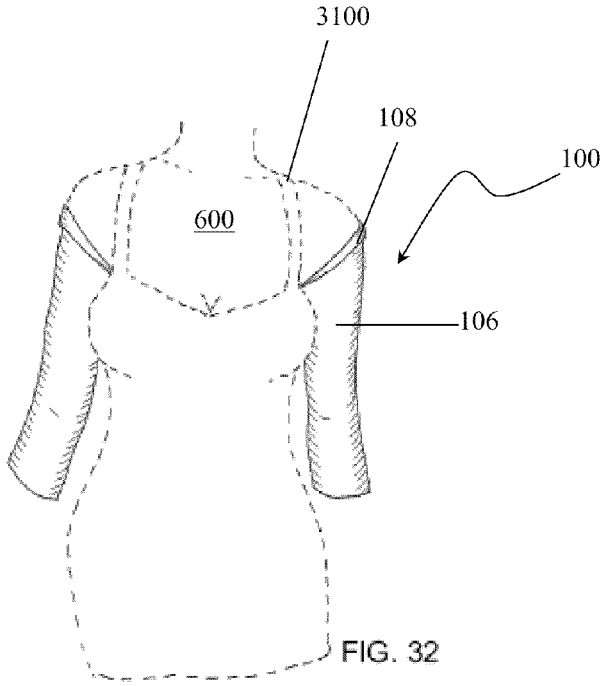
FIG. 32 is another front view of one example of a reversible sleeved garment of the present invention worn underneath a sleeveless dress, illustrating the garment accessory being worn with the low-cut side of the garment accessory worn in the front, the full coverage side worn in the back and the shoulder portion of the sleeves of the garment accessory worn off-the-shoulders.

FIGS. 31-35 all illustrate examples of the garment accessory 100, 200, 300 and 400 worn with a garment. In particular, FIG. 31 illustrates one example of a reversible sleeved garment accessory 100 worn underneath a sleeveless dress 3100. In this illustration, the garment accessory 100 is worn with the low-cut side of the garment accessory 100 in the front and the shoulder portions 108 of the sleeves 106 worn on the shoulders of the wearer. In this example, the low-cut side 102 (not shown) of the garment accessory 100 is entirely covered by the garment 3100.

Figure 33:
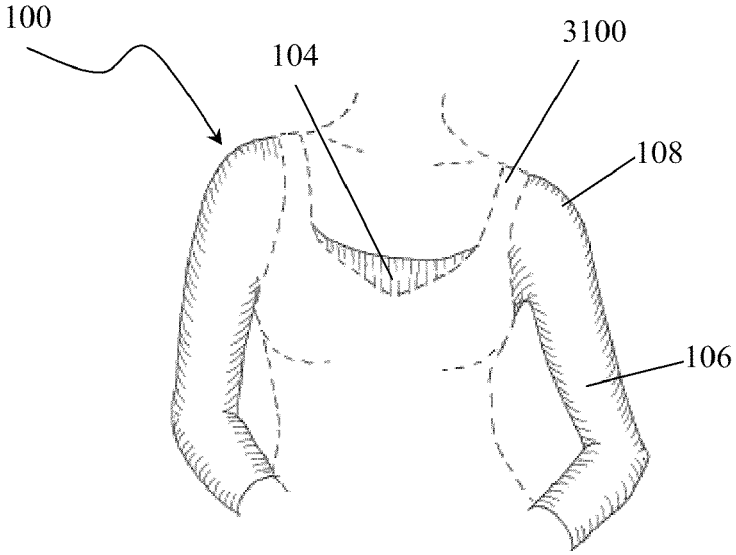
FIG. 33 is a front view of one example of a reversible sleeved garment of the present invention worn underneath a sleeveless dress, illustrating the garment accessory being worn with the full coverage side of the garment accessory worn in the front, the low-cut side worn in the back and the shoulder portion of the sleeves of the garment accessory worn on-the-shoulders.
Figure 34:
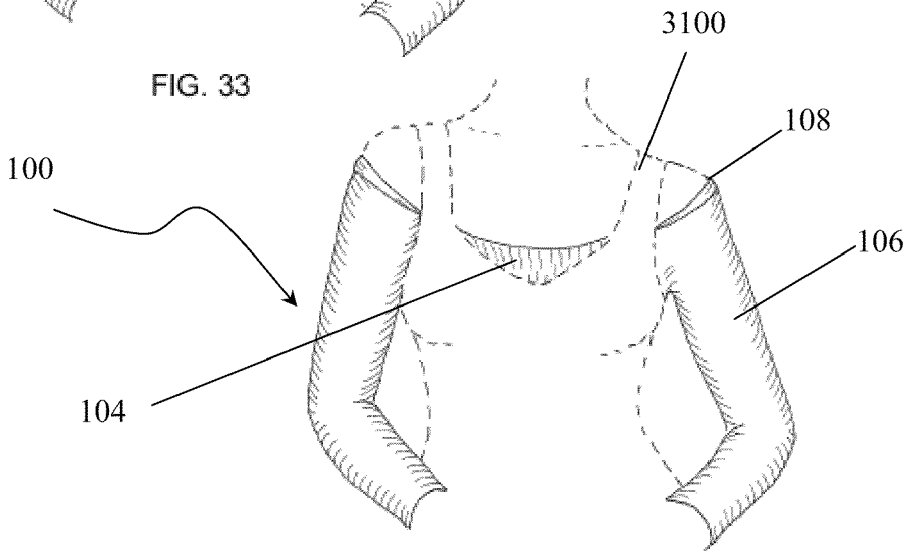
FIG. 34 is another front view of one example of a reversible sleeved garment of the present invention worn underneath a sleeveless dress, illustrating the garment accessory being worn with the full coverage side of the garment accessory worn in the front, the low-cut side worn in the back and the shoulder portion of the sleeves of the garment accessory worn off-the-shoulders.

FIG. 33 is another front view of one example of a reversible sleeved garment accessory 100 being worn with the full coverage side 104 of the garment accessory 100 worn in the front, the low-cut side 102 (not shown) worn in the back and the shoulder portions 108 of sleeves 106 of the garment accessory 100 worn on-the-shoulders. In this example, it is illustrated that the full coverage side 104, when worn in the front, may be seen from underneath the garment 3100. FIG. 34 is another front view of one example of a reversible sleeved garment 100 worn underneath a sleeveless dress 3100. This example illustrates the garment accessory 100 of FIG. 33 worn under the dress 3100, but having the shoulder portions 108 of the sleeves 106 rolled down to create another look.

Figure 35:
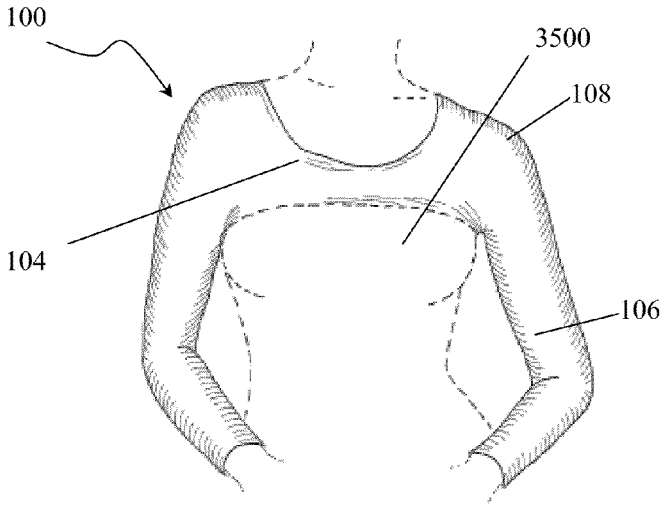
FIG. 35 is a front view of one example of a reversible sleeved garment of the present invention worn underneath a strapless dress, illustrating the garment accessory being worn with the full coverage side of the garment accessory worn in the front, the low-cut side worn in the back and the shoulder portion of the sleeves of the garment accessory worn on-the-shoulders.

FIG. 35 is a front view of one example of a reversible sleeved garment 100 of the invention worn underneath a strapless dress 3500. In this example, the reversible sleeved garment accessory 100 is worn with the full coverage side 104 of the garment accessory 100 worn in the front, the low-cut side 102 (not shown) worn in the back and the shoulder portions 108 of sleeves 106 of the garment accessory 100 worn on-the-shoulders. In this example, it is illustrated that the full coverage side 104, when worn in the front, may be seen from underneath the garment 3500.

Figure 36:
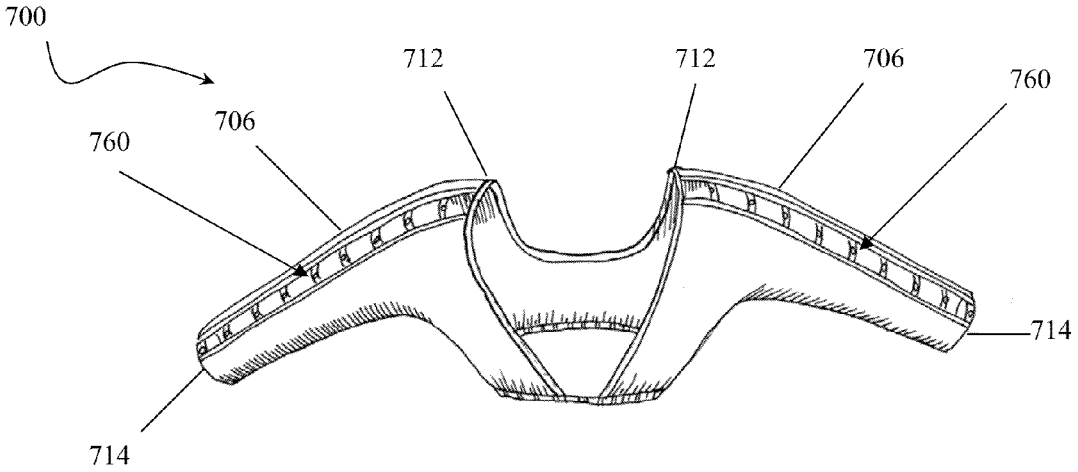
FIG. 36 is a top perspective view of yet another example of an implementation of a reversible sleeved garment accessory.

FIG. 36 is a top perspective view of yet another example of an implementation of a reversible sleeved garment accessory 700 illustrating that the arms 706 may be formed having decorative elements 760 that extend along the upper side of the arms 706 themselves from the neckline 712 to the opposing end of the sleeves 714. Such decorative elements 760 may be incorporated to accent the garment accessory 760 without creating the appearance that the garment accessory 700 is a separate piece from the garment with which it is worn.

As illustrated in FIG. 3, the first face 102 and a second face 104 are formed from a single cut of fabric to avoid seams along the shoulder and upper arm portions. Further, in the illustrated example, the first face 102, or low-cut side 102 is formed from the joining of two corresponding halves 132 and 134. To construct the garment accessory, the sleeves 106 and sides of the garment accessory 100 are then formed to by joining the sleeve 106 portion of the fabric by a seam 120 located on the underside of the sleeves that extends to along the sides (see FIGS. 4 and 5). The first face 102 and second face 104 are then designed to encircle the torso by attachment to the elastic band 110, which may or may not include a closure device 240 (see FIG. 15). Alternatively, the first face 102 and a second face 104 may be formed from two reverse cuts of fabric, in which case, both the first face 102 and second face 104 may include opposing halves, similar to the halves 132 and 134, which may be joined together at the elastic band 110. In this case, the halves may be joined to cross-over, as illustrated in connection with FIGS. 17 and 18 below. Further, the neckline 136 created by the first face 102 and second face 104 may further include elastic trim. Similarly, elastic trim may be placed at the ends 114 of the sleeves 106.

In the examples provided above, two examples of a full coverage face 104, 203, 304, 404 are illustrated; however, those skilled in the art will recognize that other styles of fuller coverage faces made be designed of varying necklines and levels of cleavage exposure. For example, the necklines may be designed to be rounder or squarer than those in the provided illustrations. In one example, the fuller coverage side is formed from a unitary piece of material having a swooping neckline, while in an alternatively illustrated designs, the fuller coverage side is constructed of two opposing pieces of fabric crossing one another at the middle. Other variation on the neck-line may be employed in the full coverage side 104, 204, 304, 404 of the garment accessory 100, 200, 300 and 400 without departing from the invention.

Similarly, two examples of a low-cut face 102, 202, 302, 402 are illustrated; however, those skilled in the art will recognize that other styles of low-cut faces may be designed of varying necklines and levels of cleavage coverage. In one example, the low-cut side is formed from two opposing pieces or halves that are separated from one another at the middle to fully expose a woman's cleavage when worn with the low-cut side on the front. In alternative designs, the separation between the two opposing pieces may be very small, may meet, or even slightly overlap to provide a small amount of coverage over a woman's cleavage when worn with the low-cut side on the front. Again, other variation on the neck-line may be employed in the low-cut side 102, 202, 302, 402 of the garment accessory 100, 200, 300 and 400 without departing from the invention (e.g., the necklines may be designed to be rounder or squarer than those in the provided illustrations).

The foregoing description has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

I claim:

1. A reversible sleeved garment accessory to be worn under a garment by a wearer, the garment accessory comprising:

a circular torso member having a first face section and a second face section and two opposing sleeve members extending from the circular torso member, where the circular torso member and the two opposing sleeve members are made of four-way stretch material such that the garment is designed to be form fitting and reversible for the wearer and where the two opposing sleeve members are not separated from the circular torso member by a seam;

where the first face section provides minimal coverage and the second face section providing fuller coverage such that the garment is designed to be worn either with the first face section or the second face section over the chest of the wearer as needed and is designed to conceal the garment accessory under an overlying garment depending upon the neckline cut of the overlying garment, and where the minimal coverage of the first face section and fuller coverage of the second face section are both designed to provide sufficient coverage to cover the nipples on the chest of the wearer when the respective face section is worn over the breast of the wearer.

2. The garment accessory of claim 1 where the circular torso member is made of a thin, light wear, sheer stretch material.

3. The garment accessory of claim 1 where the circular torso member is made at least partially from spandex.

4. The garment accessory of claim 1 further including an elastic member that encircles the garment.

5. The garment accessory of claim 4, where the elastic member is secured with a closure device.

6. The garment accessory of claim 1 further including a bodice portion extending from the circular torso member to cover the midriff of a wearer.

7. The garment accessory of claim 6 where the bodice portion is constructed of a form fitting material.

8. The garment accessory of claim 7, where the form fitting material is a nylon and spandex blend.

9. The garment accessory of claim 8 where the two opposing sleeve members are each joined together from the neckline to the end of the sleeved members via a decorative element.

10. A reversible sleeved garment accessory designed to be worn under a garment by a wearer, the garment accessory comprising:

a circular torso member having a first face section and a second face section and two opposing sleeve members extending from the circular torso member where the circular torso member and two opposing sleeve members are made of four-way stretch material such that the garment is designed to be form fitting and reversible for the wearer and having no seam separating the two opposing sleeve members from the circular torso member;

the first face section having two opposing halves creating a V-neckline on the first face section of the garment, whereby the first face section is designed to provide minimal coverage to a wearer when the first face section is worn over the breast of the wearer;

the second face section designed to have a swooping neckline on the second face section of the garment, whereby the second face section is designed to provide fuller coverage to a wearer when the second face section is worn over the breast of the wearer and where the garment is designed such that both the first and the second face sections can be worn over the breast of the wearer;

an elastic band affixed to the circular torso member, the elastic band having a closure section positioned along the elastic band between the two opposing halves of the first face section.

11. A reversible sleeved garment accessory to be worn under a garment by a wearer, the garment accessory comprising:

a circular torso member having a first face section and a second face section and two opposing sleeve members extending from the circular torso member, where the first face section provides minimal coverage and the second face section providing fuller coverage such that the garment is designed to be worn either with the first face section or the second face section over the chest of the wearer as needed and is designed to conceal the garment accessory under an overlying garment depending upon the neckline cut of the overlying garment, and where the minimal coverage of the first face section and fuller coverage of the second face section are both designed to provide sufficient coverage to cover the nipples on the chest of the wearer when the respective face section is worn over the breast of the wearer.

* * * * *